United States Patent [19]

Raymond

[11] 4,294,670

[45] Oct. 13, 1981

[54] PRECISION ELECTROPLATING OF METAL OBJECTS

[76] Inventor: Louis W. Raymond, 2500 Post Rd., Fairfield, Conn. 06430

[21] Appl. No.: 89,589

[22] Filed: Oct. 29, 1979

[51] Int. Cl.[3] ..... C25D 7/04; C25D 17/10

[52] U.S. Cl. ..... 204/26; 204/290 F

[58] Field of Search ..... 204/290 R, 292, 26, 204/272, 290 F, 32 R, 23

[56] References Cited

U.S. PATENT DOCUMENTS

| | | | |
|---|---|---|---|
| 1,474,460 | 11/1923 | Beck | 204/290 R |
| 1,709,523 | 4/1929 | Delavie | 204/290 R |
| 2,706,175 | 4/1955 | Licharz | 204/272 |
| 2,801,213 | 7/1957 | Beuckman | 204/290 F |
| 2,929,769 | 3/1960 | Newell | 204/290 |
| 2,987,453 | 6/1961 | Du Rose | 204/290 F |
| 3,065,153 | 11/1962 | Hough | 204/26 |
| 3,133,872 | 5/1964 | Miller | 204/290 F |
| 3,300,396 | 1/1967 | Walker | 204/49 |
| 3,645,881 | 2/1972 | Williams | 204/286 |
| 3,804,725 | 4/1974 | Haynes | 204/26 |
| 3,826,724 | 7/1974 | Riggs, Jr. | 204/146 |
| 3,841,990 | 10/1974 | Sasaki | 204/224 R |
| 3,860,508 | 1/1975 | Durin | 204/198 |
| 3,909,368 | 9/1975 | Raymond | 204/26 |
| 3,951,766 | 4/1976 | Cook | 204/98 |
| 4,065,377 | 12/1977 | Zollner | 204/290 F |
| 4,067,783 | 1/1978 | Okinaka | 204/43 G |

FOREIGN PATENT DOCUMENTS 133882 10/1919 United Kingdom ..... 204/290 R

*Primary Examiner*—T. M. Tufariello

*Attorney, Agent, or Firm*—Pennie & Edmonds

[57] ABSTRACT

A layer of metal of predetermined uniform thickness is electroplated onto the surface of a metal object by the use of a special composite anode having an under body of electrically conductive but anodically inert material that is covered by an outer layer of the electroplating metal of predetermined uniform thickness. The composite anode is positioned in close proximity to the surface of the metal object being electroplated with the facing surfaces of the anode and the metal object spaced a predetermined distance apart. The space between the anode and the metal object is filled with an aqueous electrolyte, and an electrolyzing current is passed through the electrolyte between the anode and the metal object to cause electroplating metal from the outer layer of the anode to be electrolytically dissolved in the electrolyte and to cause an exactly equal amount of the metal to be deposited on the facing surface of the metal object being electroplated. When all of the outer layer of electroplating metal has been removed from the surface of the anode, the electrode position of said metal onto the surface of the metal object will terminate, the resulting layer of metal on the surface of the metal object being of a predetermined uniform thickness throughout.

5 Claims, 5 Drawing Figures

PRECISION ELECTROPLATING OF METAL OBJECTS

TECHNICAL FIELD

This invention relates to the electroplating of a layer of metal of predetermined uniform thickness on the surface of a metal object.

BACKGROUND ART

In the conventional process for electroplating a layer of metal on the surface of a metal object, a consumable anode of the electroplating metal and a cathode comprising the metal object being electroplated are placed in an electrolyte solution (the electroplating bath) containing a cation of the electroplating metal, and an electrolyzing current is passed through the electrolyte between the anode and the metal object (the cathode) to cause electroplating metal to dissolve into the electrolyte at the anode and to electrolytically deposit an electrolytically equivalent amount of said metal on the surface of the cathode. The thickness of the metal layer being deposited on the surface of the cathode may vary from one point or area of the cathode to another due to variety of factors including the resistivity of the solution, the presence of gases in the solution or on the surface of the electrodes, the shape and spacing of the anode and the cathode, variations in temperature and in current density, and the like. Nonetheless, in most cases a layer of electrodeposited metal of relatively uniform thickness that is satisfactory for most purposes can be obtained throughout the entire area of the cathode being electroplated by appropriate design and placement of the anode and cathode and by appropriate control of bath temperature, current density and other electrolytic conditions of the electroplating system. However, in other cases where the layer of electrodeposited metal must be of a precise and uniform thickness in order to meet the stringent working tolerances required of the part being plated, or where the shape of the part or the physical relationship of the anode and the part present special problems, the aforementioned conventional procedures are not always sufficient to insure the production of a layer of electrodeposited metal of the required uniform thickness. In such other cases, special procedures must be devised to insure the reliable electrodeposition of metal layers of acceptably precise thickness.

For example, in the precision electroplating of the cylindrical inner surfaces of such tubular metal objects as engine cylinder liners, gun barrels, deep well pumps and the like, the consumable anode of the electroplating system is a metal wire or rod that is positioned centrally within the cylindrical wall of the tubular object, the cathode of the system being the inner surface of the tubular object being electroplated. The electrolyte solution is disposed in the annular space between the anode and the cathode, and a predetermined amount of an electrolyzing current is passed between the two electrodes to cause a predetermined amount of electroplating metal to dissolve at the anode and an equal amount of this metal to deposit on the surface of the cathode. Despite the utmost care in the placing of the anode centrally within the tubular cathode and in the control of the electrolytic conditions, the thickness of the layer of metal electrodeposited on the inner surface of the cathode will vary slightly from one point to another due to to the effect of one or more of the disruptive factors previously mentioned. Moreover, the minor differences in thickness that do develop become progressively greater as long as the electroplating operation continues and metal from the entire surface of the consumable anode continues to dissolve into electrolyte solution and to be deposited on the entire surface of the cathode being plated. That is to say, as long as metal is supplied to the electrolytic solution throughout the entire area of the consumable anode that is exposed to the solution, the same disruptive factors which initially cause the minor variations in the thickness of the layer of metal deposited on the cathode continue to operate and thereby to accenuate and increase these variations in thickness.

After an intensive investigation of the problems involved in the precision electroplating of metal objects, and in particular plating of the cylindrical inner surfaces of such metal objects as are referred to above, I have discovered that a layer of metal of predetermined uniform thickness can be reliably electrodeposited on the surface of a metal object by means of a composite anode of unique construction that, when used in an electroplating system of the type described above, automatically terminates the electrodeposition of metal on the surface of the cathode when the layer of metal reaches the desired uniform thickness.

DISCLOSURE OF THE INVENTION

As previously noted, the surface of a metal object is plated with a layer of an electroplating metal by placing the metal object and a consumable anode comprising the source of the electroplating metal in or in contact with an aqueous electrolyte solution containing a cation of the electroplating metal and by passing an electrolyzing current through the aqueous electrolyte solution between the facing surfaces of the anode and the object being electroplated. Electroplating metal will be electrolytically dissolved at the surface of the anode and an exactly equal amount of said metal will be electrolytically deposited on the facing surface of the metal object as long as the electrolyzing current continues to pass between the anode and the metal object. In accordance with the present invention, a layer of metal of predetermined uniform thickness is deposited on the surface of the metal object by the use of the unique composite anode of the invention, the anode automatically terminating the flow of electrolyzing current between the anode and the metal object when a predetermined amount of electroplating metal has been electrolytically dissolved at the anode and deposited on the facing surface of the metal object.

The composite anode of the invention has an under body of electrically conductive but anodically inert material and an outer layer of the metal being electroplated on the surface of the metal object. The outer layer of electroplating metal of the anode has a predetermined uniform thickness and completely covers the surface of the under body of the anode that faces the surface of the metal object being electroplated. As noted, the flow of electrolyzing current between the anode and the metal object causes the outer layer of electroplating metal of the anode to be electrolytically dissolved and causes an exactly equal amount of said metal to be electrolytically deposited on the facing surface of the metal object. When the outer layer of metal has been completely removed (by electrolytic dissolution of the metal) from any given area of the anode the underlying under body of the anode will be exposed to the electrolyte solution thereby immediately terminating the flow of electrolyzing current from that area of the anode with the concomittant termination of the electrodeposition of said metal onto the corresponding area of the surface of the metal object being electroplated. As the outer layer of electroplating metal of the anode is of a predetermined uniform thickness the layer of metal electroplated onto the surface of the metal object is also of a predetermined uniform thickness, the uniformity in the thickness of the layer of electrodeposition metal being a result of the automatic termination or cutting off of the flow of electrolyzing current when the said predetermined amount of metal has been transferred from any given point on the surface of the anode to the corresponding point on the surface of the metal object.

The under body of the composite anode is made of a material that will conduct electricity when employed as the cathode in an electroplating system but will not conduct electricity when employed as the anode in such a system. Among the materials which possesses this property is metallic titanium which I presently prefer to use for the under body of the anode. The outer layer of the anode may comprise any metal that can be electrolytically deposited on the surface of a cathode from an aqueous electrolyte containing a cation of the metal. The outer layer of electroplating metal is of predetermined uniform thickness and is advantageously applied to the under body of the anode in an electroplating procedure wherein the metal is electrodeposited onto the surface of the under body of the electrode, the electrodeposition of the metal being carried out until a layer of the desired thickness has been deposited thereon. The resulting composite electrode is then employed as the anode in the process of the invention.

BRIEF DESCRIPTION OF THE DRAWING

The precision electroplating of a layer of metal of predetermined uniform thickness in accordance with the invention will be better understood from the following detailed description thereof in conjunction with the accompanying drawings of which:

FIG. 3(*b*) is an enlarged fragmentary view similar to FIG. 3(*a*) showing the relative amounts of plating metal on the facing surfaces of the composite anode and the metal object at some intermediate time in the electroplating operation; and FIG. 3(*c*) is an enlarged fragmentary view similar to FIG. 3(*a*) showing the relative amounts of plating metal on the facing surfaces of the anode and the metal object upon completion of the electroplating operation.

BEST MODE FOR CARRYING OUT THE INVENTION

As previously noted, the present invention relates to the electroplating of a layer of metal of predetermined uniform thickness on the surface of a metal object. As in the conventional process for electroplating a layer of metal on the surface of the metal object, a consumable anode of the electroplating metal and the metal object being electroplated are placed in or in contact with an aqueous electrolyte solution containing a cation of the electroplating metal. An electrolyzing current is then passed through the electrolyte between the anode and the metal object (the cathode of the system) to cause electroplating metal to dissolve into the electrolyte at the anode and to cause an electrolytically equivalent amount of this metal to deposit on the surface of the cathode. The electroplating process of the invention employs a composite anode of unique construction which insures that the electrodeposition of metal on the surface of the cathode will automatically terminate when the layer of metal has reached a predetermined uniform thickness. The improved electroplating procedure is particularly useful in the electroplating of the interior surfaces of cylindrical metal objects and will be described below in conjunction with the electroplating of such objects. However, it will be understood that the electroplating procedure and the composite anode employed therein are not limited to the electroplating of such objects.

Figure 1:
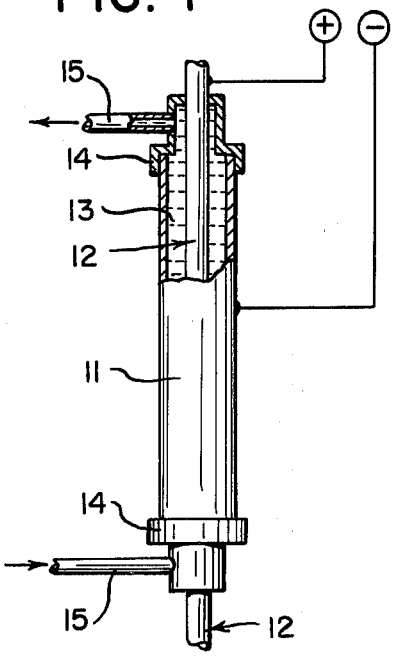
FIG. 1 is a schematic side elevation, partly in section, of a typical arrangement for the electroplating of a uniform layer of metal on the inner surface of a cylindrical metal object.

As shown best in FIG. 1, the cathode 11 of the electroplating system embodying the present invention advantageously comprises a tubular metal object such as an engine cylinder liner, a gun barrel, a pump casing or the like, the inner surface of which is to have a layer of metal of predetermined uniform thickness electroplated thereon. The composite anode 12 of the system comprises a cylindrical metal rod or wire that is positioned centrally with respect to the longitudinal axis of the tubular cathode 11 and that serves as the source of the metal electroplated on the inner surface of the tubular cathode. The annular space between the inner surface of the tubular cathode 11 and the outer surface of the composite anode 12 is filled with an aqueous electrolyte 13 containing the cation of the metal being electrodeposited on the inner surface of the cathode. End closure means 14 are provided for centering the anode 12 within the tubular cathode 11 and for retaining the aqueous electrolyte 13 within the cathode. The closure means 14 are electrically non-conductive and are provided with an electrolyte inlet and outlet means 15 for the circulation of electrolyte solution and the venting of gases as shown schematically in the accompanying drawing.

As noted, the passage of an electrolyzing current between the cathode 11 and anode 12 causes electroplating metal to dissolve into the aqueous electrolyte at the anode and causes this metal to deposit on the inner surface of the cathode in the manner well known in the art. Theoretically, the amount of metal dissolved in the electrolyte at the anode and the amount of metal from the electrolyte deposited on the inner surface of the cathode are both directly proportional to the amount of electrolyzing current that passes between the two electrodes of the system, and therefore it should be relatively easy to predict and control the thickness of the layer of metal deposited on the cathode. However, for the reasons previously mentioned minor variations in the thickness of the metal deposit invariably occur, and these variations are accentuated and tend to increase as long as the electrolyzing current continues to flow from the surface of the anode to the immediately facing surface of the cathode. The composite anode 12 of the invention automatically terminates the flow of electrolyzing current from any given area of the anode to the corresponding area (i.e., the immediately facing area) of the cathode when a predetermined amount of electroplating metal has been electrolytically transferred from the said given area of the anode to the said corresponding area of the cathode, thereby making possible the electrodeposition of a layer of electroplating metal of predetermined uniform thickness throughout the entire area of the cathode being electroplated.

Figure 2:
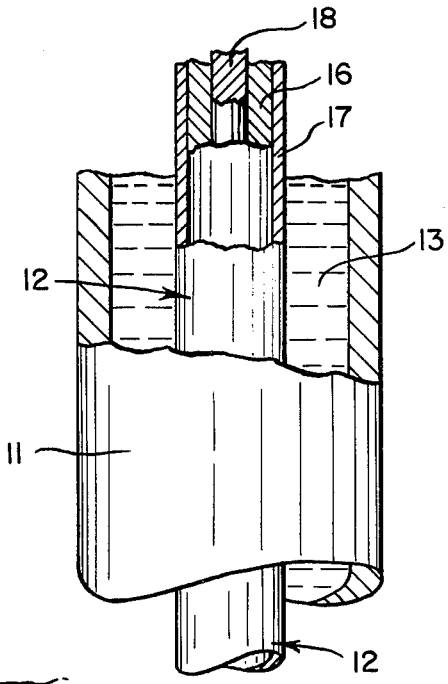
FIG. 2 is an enlarged fragmentary view of the electroplating arrangement of FIG. 1 showing the composite construction of the anode of the invention.

As shown in FIG. 2, the composite anode 12 has an under body 16 of electrically conductive but anodically inert material, an outer layer 17 of the metal that is being electrodeposited on the inner surface of the cathode 11 and, advantageously, an inner core 18 of a metal such as copper having a relatively high electrical conductivity. The term "electrically conductive but anodically inert" as employed herein refers to a material that will conduct electricity under all ordinary circumstances including the use of the material as the cathode in an electroplating procedure but which will not conduct electricity whem immersed in or brought into contact with an aqueous electrolyte and employed as an anode in an electroplating or other electrolytic procedure. There are a number of materials which possess these properties. Of these I presently prefer to use metallic titanium as the under body 16 of the composite anode 12 of the invention. The relatively high electrical conductivity of the inner core 18 compensates for the relatively low conductivity of the under body 16 and the thereby reduces heat losses during the electroplating operation.

The outer layer 17 of the anode 12 is made of a metal such as nickel, copper, zinc, tin, iron, silver and the like that can be electroplated onto the surface of a metal cathode in a conventional electroplating operation employing an aqueous electrolyte containing a cation of the electroplating metal. The layer 17 of electroplating metal is of predetermined uniform thickness and completely covers the surface of the under body 16 of the anode 12, and in particular the surface of the anode that faces the surface of the cathode being electroplated. The metal layer 17 may be applied to the surface of the under body 16 by any appropriate procedure. I presently prefer to apply the layer 17 by means of a conventional electroplating operation wherein the layer is electrodeposited on the outer surface of the under body 16. The electrodeposition of a layer of electroplating metal of a predetermined uniform thickness on the under body 16 is achieved by careful control of the electrolytic conditions followed, if necessary, by machining the composite anode or by drawing the anode through a scalping die to obtain an outer layer 17 of the precise thickness required.

Figure 3:
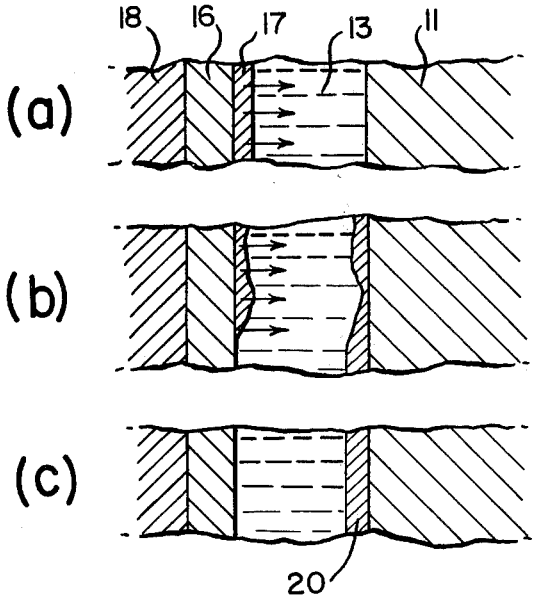
FIG. 3(*a*) is an enlarged schematic view of adjacent portions of the composite anode and the metal object being electroplated showing the relative amounts of plating metal on the facing surfaces of the composite anode and the metal object at the start of the electroplating operation.

The manner in which the composite anode 12 of the invention serves to produce an electrodeposited layer of metal of predetermined uniform thickness on the surface of the cathode 11 is illustrated schematically in FIGS. 3(*a*), 3(*b*) and 3(*c*) of the drawings. As shown in FIG. 3(*a*) the composite anode 12 having an under body 16 of electrically conductive but anodically inert material and an outer layer 17 of electroplating metal is placed in close proximity to the cathode 11 to be electroplated with the facing surfaces of the two electrodes spaced a uniform distance apart. The space between the anode 12 and the cathode 11 is filled with an aqueous electrolyte 13 containing a cation of the electroplating metal, and an electrolyzing current is passed through the electrolyte solution between the anode and the cathode. The passage of the electrolyzing current between the two electrodes causes electroplating metal from the layer 17 to dissolve at the anode 12 and to deposit in layer 20 on the facing surface of the cathode 11 in the manner previously described, and this electrolytic transfer of metal from the anode to the cathode will continue until all of the electroplating metal has been removed from the surface of the anode.

As the electroplating operation proceeds, minor variations in the amount of metal dissolved in the electrolyte 13 at the anode 12 and electroplated therefrom at the cathode 11 invariably occur, with consequent minor variations in the thickness of the metal layer 20 deposited on the cathode as indicated in an exaggerated manner in FIG. 3(*b*) of the drawing. When all of the metal layer 17 in any given area of the anode 12 has been dissolved in the electrolyte solution 13, the surface of the underlying anodically inert under body 16 of the anode will be exposed to the solution, and as a result electrolyzing current will cease to flow between the said given area of the anode and the corresponding area of the cathode 11 immediately opposite thereto, thereby terminating the electrodeposition of metal in this area of the surface of the cathode. In the meantime, electrolyzing current will continue to flow between the two electrodes in those areas where the anode is still covered with the remains of the outer layer 17 of the electroplating metal as also indicated in FIG. 3(*b*). When all of the metal layer 17 has been discovered in the electrolyte solution the entire surface of the under body 16 of the anode will be exposed to the solution and the flow of electrolyzing current will terminate altogether as indicated schematically in FIG. 3(*c*) of the drawing.

The amount of electroplating metal available for transfer from any given area of the anode 12 to the corresponding area of the cathode 11 is dependent upon the thickness of the metal layer 17 in that area of the anode, and as the flow of electrolyzing current between these areas of the anode and the cathode is terminated when all of the metal layer 17 in this area has been consumed, the thickness of the metal layer 20 deposited on the surface of the cathode 11 is also dependent upon and is determined by the thickness of the metal layer 17 of the anode 12. As the layer 17 of electroplating metal on the surface of the composite anode 12 is of predetermined uniform thickness, the layer 20 of metal electrodeposited on the cathode will also be of a predetermined uniform thickness. Accordingly, it will be seen from the foregoing description of the practice of the invention that a layer 20 of metal of predetermined uniform thickness can be reliably electrodeposited on the surface of a cathodic metal object 11 by the use of the composite anode 12 of the invention.

I claim:

1. In the process for the precision electroplating of a layer of metal of predetermined uniform thickness on the surface of a metal object in which an anode comprising the source of the metal being electroplated on the surface of the metal object is positioned in close proximity to said surface with the facing surfaces of the anode and the metal object spaced a predetermined uniform distance apart, in which the space between said facing surfaces of the anode and the metal object being electroplated is filled with an aqueous electrolyte containing a cation of the electroplating metal and in which an electrolyzing current is passed through said aqueous electrolyte between the facing surfaces of the anode and the object being electroplated to cause the electroplating metal of the anode to be electrolytically dissolved in the aqueous electrolyte and to cause an exactly equal amount of said metal to be electrolytically deposited on said facing surface of the metal object being electroplated, the improvement which comprises:

employing a composite anode having an under body of generally electrically conductive but anodically non-conductive material on the surface of which under body is disposed an outer layer of the metal being electroplated on the surface of the metal object, said outer layer of electroplating metal of the anode initially being of predetermined uniform thickness and completely covering the surface of the under body of the anode that immediately faces the surface of the metal object being electroplated, and continuing the electroplating operation to effect the complete electrolytic dissolution of the outer layer of electroplating metal of the anode, the complete removal of said outer layer of electroplating metal from any given area of the anode under body automatically terminating the flow of electrolyzing current from that area of the anode with the concomitant termination of the electrodeposition of said metal onto the corresponding area of the metal object being electroplated, whereby a layer of metal of predetermined uniform thickness is electroplated onto the surface of said metal object.

2. The process according to claim 1 in which the under body of the composite anode is titanium and the outer layer of said anode is nickel.

3. The process according to claim 1 in which the metal object being electroplated has a hollow generally cylindrical configuration and in which the anode is positioned centrally within said hollow metal object with the outer surface of the anode spaced a predetermined distance from the facing inner surface of the metal object, said anode having a generally cylindrical under body of anodically inert material covered by an outer layer of electroplating metal of predetermined uniform thickness.

4. The process according to claim 3 in which the composite anode has a generally cylindrical inner core that underlies the under body of said anode, the inner core being a metal of relativley high electrical conductivity.

5. The process according to claim 4 in which the inner core of the composite anode is copper, the under body of said anode is titanium and the outer layer of said anode is nickel.

* * * * *